US007794375B1

(12) United States Patent
Jackson, Jr. et al.

(10) Patent No.: US 7,794,375 B1
(45) Date of Patent: Sep. 14, 2010

(54) EXERCISE APPARATUS FOR STRENGTHENING HAMSTRING MUSCLES AND ASSOCIATED METHOD

(76) Inventors: David P. Jackson, Jr., 6769 Sundown Dr., Riverside, CA (US) 92509; Warren McCoy, P.O. Box 317, Riverside, CA (US) 92509

( * ) Notice: Subject to any disclaimer, the term of this patent is extended or adjusted under 35 U.S.C. 154(b) by 0 days.

(21) Appl. No.: 12/454,990

(22) Filed: May 27, 2009

Related U.S. Application Data

(60) Provisional application No. 61/128,874, filed on May 27, 2008.

(51) Int. Cl.
*A63B 21/00* (2006.01)

(52) U.S. Cl. ..... 482/132; 135/67

(58) Field of Classification Search ..... 482/132, 482/142, 126; 135/65, 67; 472/1; D12/130
See application file for complete search history.

(56) References Cited

U.S. PATENT DOCUMENTS 2,576,178 A * 11/1951 Hiles et al. ..... 104/172.2
2,662,579 A * 12/1953 Douglas et al. ..... 280/87.03
2,728,585 A * 12/1955 Walline ..... 280/62
2,745,679 A * 5/1956 Lien ..... 280/218
3,227,465 A * 1/1966 Massie ..... 280/5.2
3,583,727 A * 6/1971 Wallis ..... 280/283
3,976,155 A * 8/1976 Esch ..... 280/32.5
4,052,082 A * 10/1977 Jones et al. ..... 280/87.021
4,403,673 A * 9/1983 Ball ..... 180/214
4,506,901 A * 3/1985 Tosti ..... 280/250.1
4,620,714 A * 11/1986 Davis ..... 280/250.1
4,635,933 A 1/1987 Schnell
4,822,064 A * 4/1989 Hunter ..... 280/30
5,161,812 A * 11/1992 DeWeese ..... 280/47.38
D367,251 S * 2/1996 Ahlberg et al. ..... D12/129
5,669,864 A * 9/1997 Brister ..... 482/132
5,772,234 A * 6/1998 Luo ..... 280/642
D396,437 S * 7/1998 Liljedahl ..... D12/130
5,813,681 A * 9/1998 Saint et al. ..... 280/87.051
6,089,593 A * 7/2000 Hanson et al. ..... 280/650
6,456,885 B1 9/2002 Shiba et al.
D481,336 S * 10/2003 Wu ..... D12/130
6,776,433 B2 * 8/2004 Harrison et al. ..... 280/647
6,834,734 B2 * 12/2004 Wu ..... 180/65.51
6,929,275 B1 * 8/2005 Schlangen ..... 280/250.1
6,981,709 B2 * 1/2006 Saint ..... 280/47.38
7,052,030 B2 * 5/2006 Serhan ..... 280/304.1
7,309,081 B1 * 12/2007 Zuhlsdorf et al. ..... 280/781
7,451,992 B2 * 11/2008 Willis ..... 280/87.05
7,644,937 B2 * 1/2010 Giampavolo et al. ... 280/33.991
2002/0070533 A1 * 6/2002 Owens ..... 280/650

(Continued)

*Primary Examiner*—Lori Baker

(57) ABSTRACT

A hamstring exercise apparatus preferably includes a frame provided with a seat section, handle bars, rear axle, rear wheels and swiveling front wheels. The seat section is mounted at a front end of the frame such that the frame is provided with a first opening intermediately disposed between the rear axle and the seat section for receiving user feet therethrough while the user is seated on the seat section and facing the rear end of the frame. Such a frame is further provided with a second opening intermediately disposed between the handle bars. The second opening receives the user feet therethrough while the user is seated on the seat section and facing the front end of the frame. Such first and second openings are advantageously provided for providing room for feet or foot placement and leg movements as the hamstring exercise apparatus is propelled forward during use.

14 Claims, 4 Drawing Sheets

U.S. PATENT DOCUMENTS

2002/0125709 A1* 9/2002 Wu ..... 280/771
2003/0205881 A1* 11/2003 Shapiro et al. ..... 280/200
2005/0218613 A1* 10/2005 Giampavolo et al. ... 280/33.993
2008/0309039 A1* 12/2008 Bailey et al. ..... 280/47.34
2009/0206578 A1* 8/2009 Pizmony et al. ..... 280/648

* cited by examiner

EXERCISE APPARATUS FOR STRENGTHENING HAMSTRING MUSCLES AND ASSOCIATED METHOD

CROSS REFERENCE TO RELATED APPLICATIONS

This application claims the benefit of U.S. Provisional Application No. 61/128,874, filed May 27, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to exercise assemblies and, more particularly, to a compact rolling exercise assembly for increasing hamstring strength and the like for providing exercise enthusiasts with a convenient means of keeping fit.

2. Prior Art

The strength-building exercise devices most commonly used today, free weights and stationary machines, suffer from many disadvantages. Free weights, while conducive to a broad range of exercises, can be expensive, unsafe and cumbersome to use. Stationary machines, whether plate-loaded or provided with a weight stack, typically only focus on one muscle or muscle group, require a great amount of space, and are often complicated and awkward to use. Due to expense and size, these devices are not readily adaptable to home use. Additionally, these devices are not capable of providing lifting assistance to users such as rehabilitation patients who are just regaining strength.

Accordingly, a need remains for a compact rolling exercise assembly for increasing hamstring strength and the like in order to overcome the above-noted shortcomings. The present invention satisfies such a need by providing an assembly that is convenient and easy to use, is durable yet lightweight in design, is versatile in its applications, and provides users with a simple, low-cost, and effective means of strengthening the hamstring muscle group.

BRIEF SUMMARY OF THE INVENTION

In view of the foregoing background, it is therefore an object of the present invention to provide an exercise apparatus for strengthening hamstring muscles and associated method. These and other objects, features, and advantages of the invention are provided by a specially designed exercise device that can conveniently be used in the home, the present invention allows virtually any user to enjoy the benefits of hamstring muscle building in an easy and expedient manner. Since it is operated with the simplest of body motions, the exercise apparatus allows old and young users alike to take the necessary steps to build hamstring strength, even for simple walking.

In a preferred embodiment, the hamstring exercise apparatus preferably includes a portable frame adapted to receive and support a user thereon. The frame may further include a rear axle extending transversely to a longitudinal length of the frame. The rear axle has a planar top surface spanning along an entire width of the frame for receiving and supporting the user feet thereon. The present invention further includes a plurality of coextensively shaped handle bars extend upwardly from the front end of the frame and statically engage the seat section.

Advantageously, a seat section is mounted at a front end of the frame such that the frame is provided with a first opening intermediately disposed between the rear axle and the seat section for receiving user feet therethrough while the user is seated on the seat section and facing the rear end of the frame. Such a frame is further provided with a second opening intermediately disposed between the handle bars. The second opening receives the user feet therethrough while the user is seated on the seat section and facing the front end of the frame. Such first and second openings are advantageously provided for providing room for feet or foot placement and leg movements as the hamstring exercise apparatus is propelled forward during use.

Such a structural configuration solves the problem of unnecessarily tearing the hamstring muscle during training and rehabilitative procedures. Thus, the present invention provides the unexpected and unpredictable advantage of strengthening hamstring muscle groups without tearing muscle fibers. This advantageous result minimizes tears, strains, pulls, and other hamstring weaknesses. In this manner, the exercise apparatus is not stationary, unlike conventional weight-lifting and nautilus machines. A user is able to determine his/her performance by measuring strength, endurance and speed gains by tracking his/her endurance and efficiency over time.

The present invention further includes a plurality of coextensively shaped front swivel wheels coupled to the front end of the frame, and a plurality of coextensively shaped rear wheels coupled to the rear axle. The front swivel wheels may be freely rotated along a corresponding vertical axis registered orthogonal to the bottom section. Such handle bars are forwardly offset from the vertical axes and thereby allow the user to lean forwardly and away from the seat section during exercising procedures. The rear wheels are fixedly aligned along a uniform direction and rotate about an x-axis without swiveling away from the uniform direction as the front swivel wheels rotate about the vertical axes respectively. In this manner, the hamstring exercise apparatus is easily maneuvered along tight corners and space-limited areas during exercising procedures.

The frame further includes a U-shaped bottom section having a rear end situated distally of the rear axle for providing support to the user feet. Such a bottom section extends along an entire longitudinal length of the frame and is monolithically formed with the handle bars at the front end of the frame. The bottom section is oriented along a horizontal plane registered above the rear axle and thereby supported by the rear axle.

The seat section may be centrally mounted above the front swivel wheels, which advantageously optimize movement while the hamstring training apparatus is in use. Such a seat section preferably includes first and second rectilinear legs extending upwardly from the bottom section of the frame. Such legs are registered orthogonal to the bottom section and located midway along the longitudinal length of the bottom section. A rectangular platform is statically mated to top ends of the legs and the handle bars respectively; wherein the platform is centrally aligned along a width of the frame. A pad is situated on the platform for providing a cushioned surface on which the user sits during operating conditions. Such a pad may be formed from a comfortable, cushiony foam or rubber upholstered in an attractive material.

The present invention further includes a method of utilizing a hamstring exercise apparatus for strengthening hamstring muscles. Such a method preferably includes the chronological steps of: initially providing a portable frame adapted to receive and support a user thereon. Such a frame includes a rear axle extending transversely to a longitudinal length of the frame, a seat section mounted at a front end of the frame, and a plurality of coextensively shaped handle bars extending upwardly from the front end of the frame and statically engaged to the seat section. The frame may be provided with a first opening intermediately disposed between the rear axle and the seat section. The frame further may have a second opening intermediately disposed between the handle bars.

The method further the chronological steps of: providing and coupling a plurality of coextensively shaped front swivel wheels to the front end of the frame; providing and coupling a plurality of coextensively shaped rear wheels to the rear axle; positioning user feet through the first opening while the user is seated on the seat section and facing the rear end of the frame; and positioning the user feet through the second opening while the user is seated on the seat section and facing the front end of the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
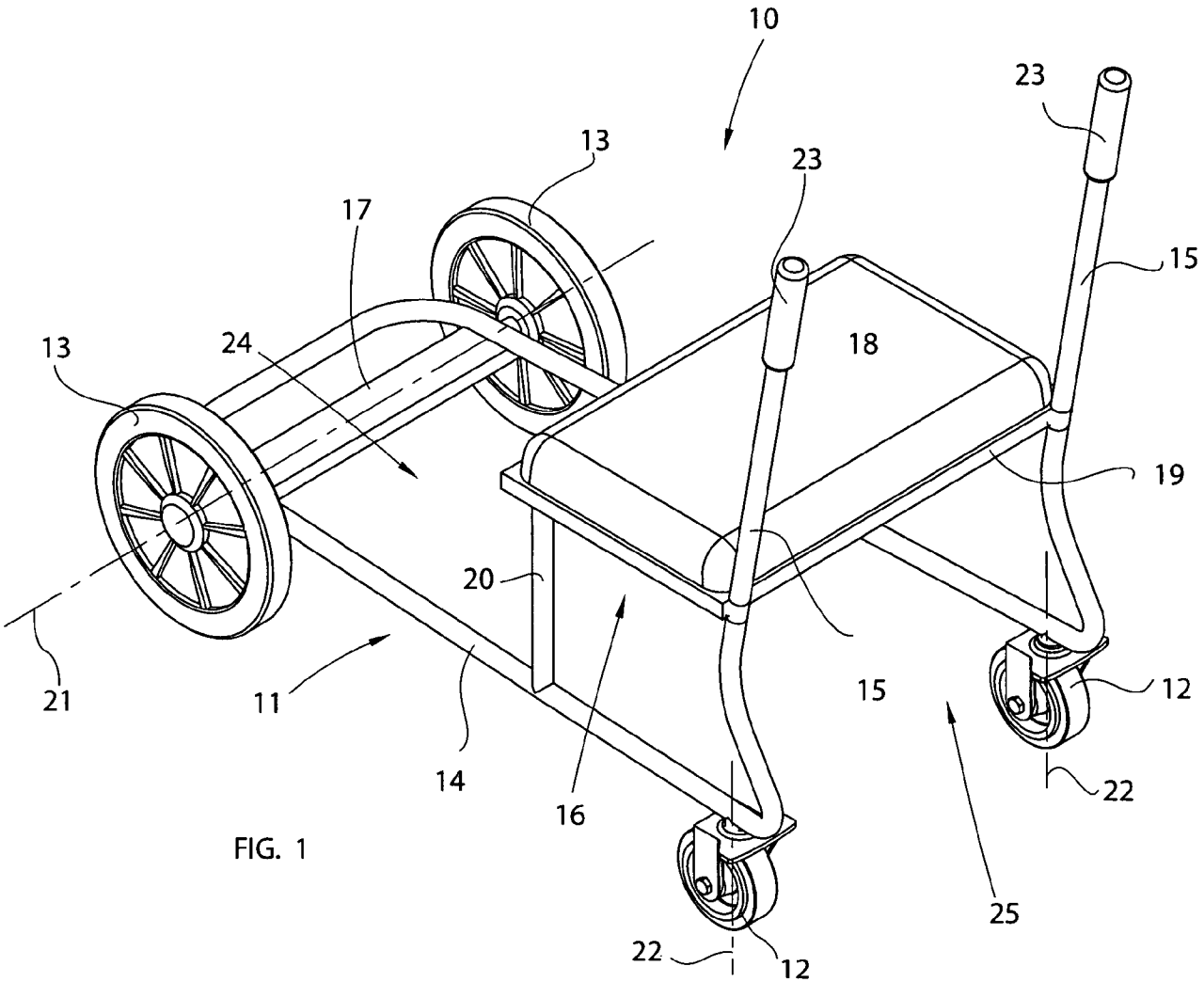
FIG. 1 is a perspective view showing an exercise apparatus for strengthening hamstring muscles, in accordance with the present invention.
Figure 2:
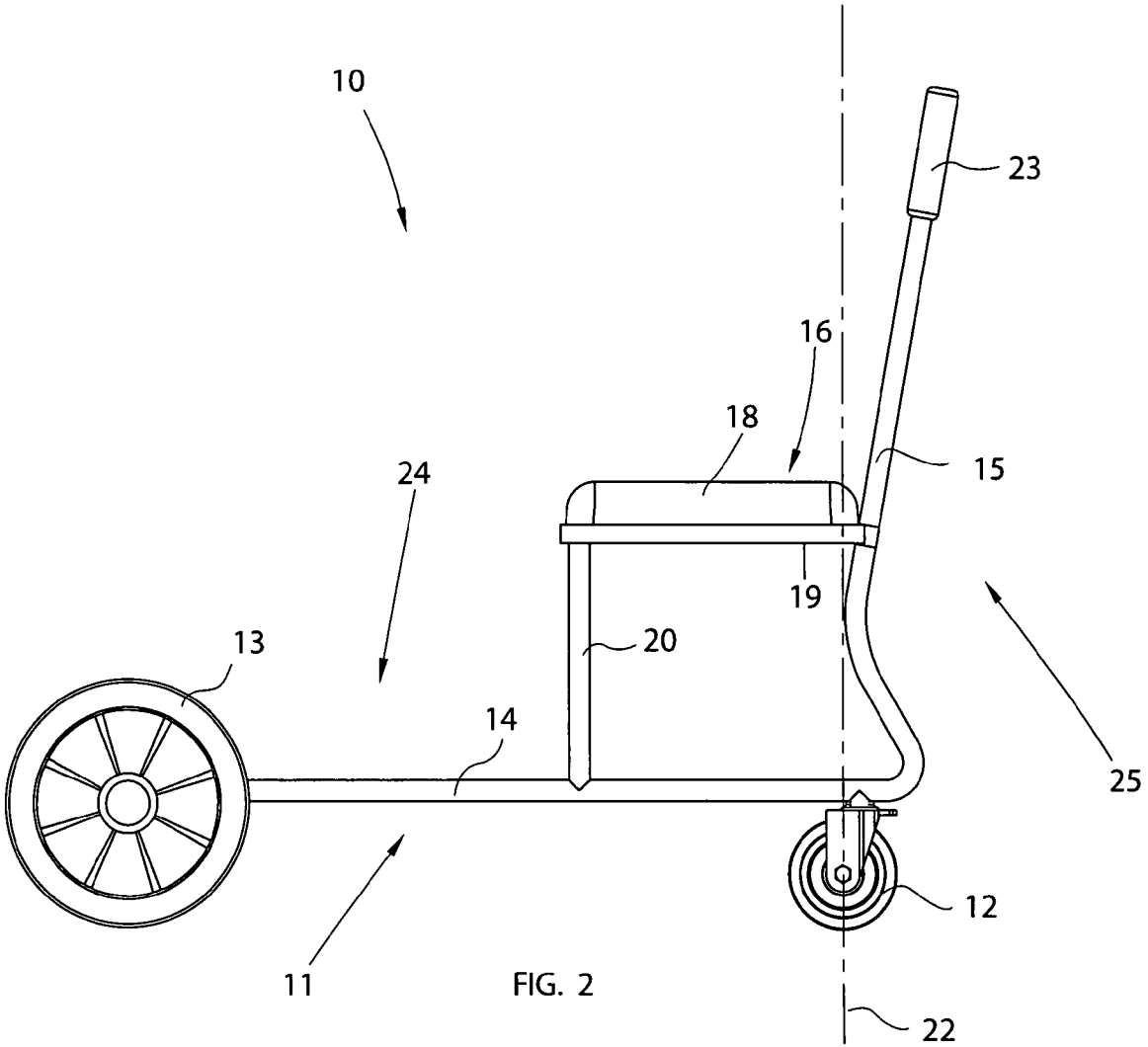
FIG. 2 is a side elevational view of the exercise apparatus shown in FIG. 1.
Figure 3:
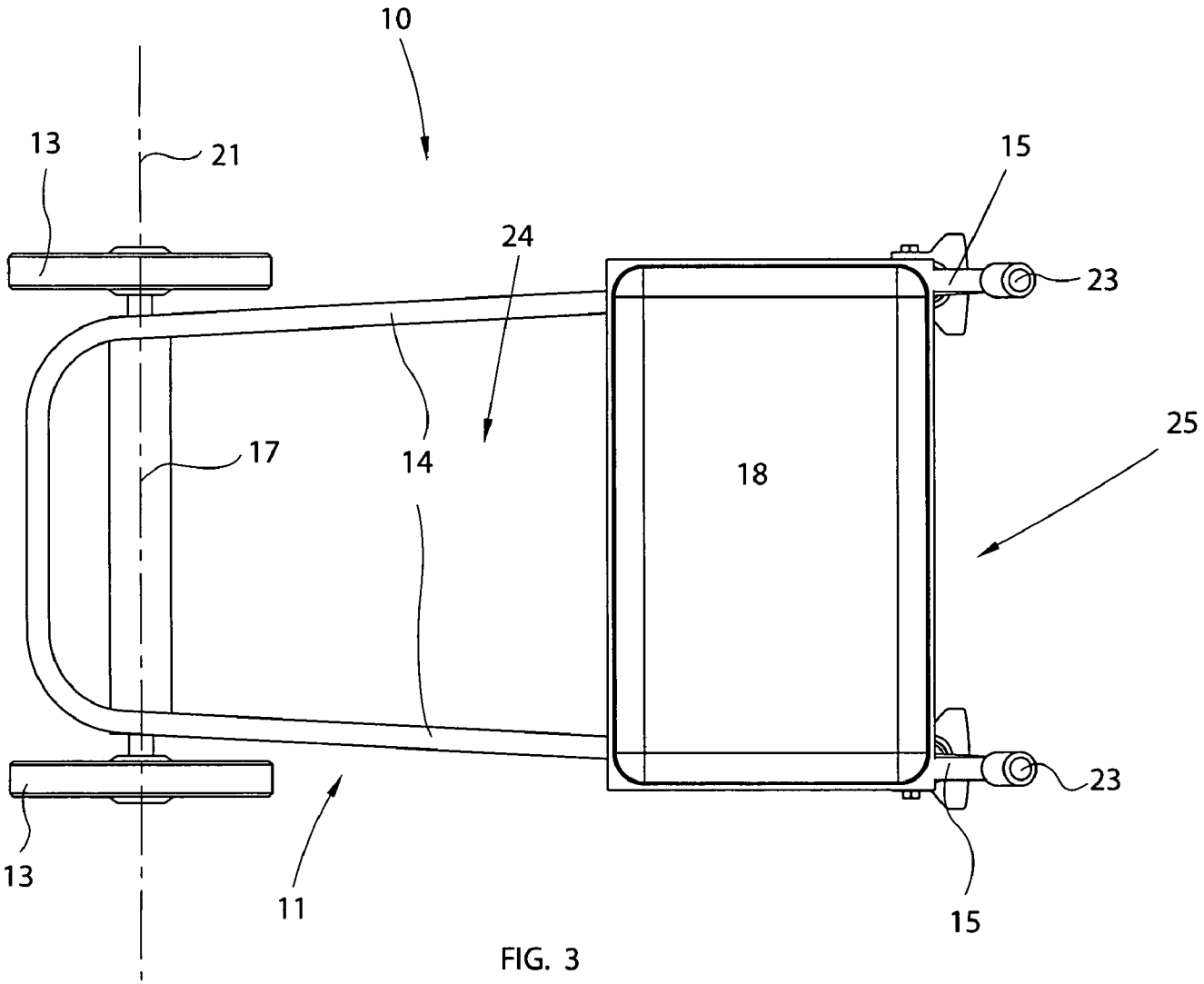
FIG. 3 is a top plan view of the exercise apparatus shown in FIG. 1.
Figure 4:
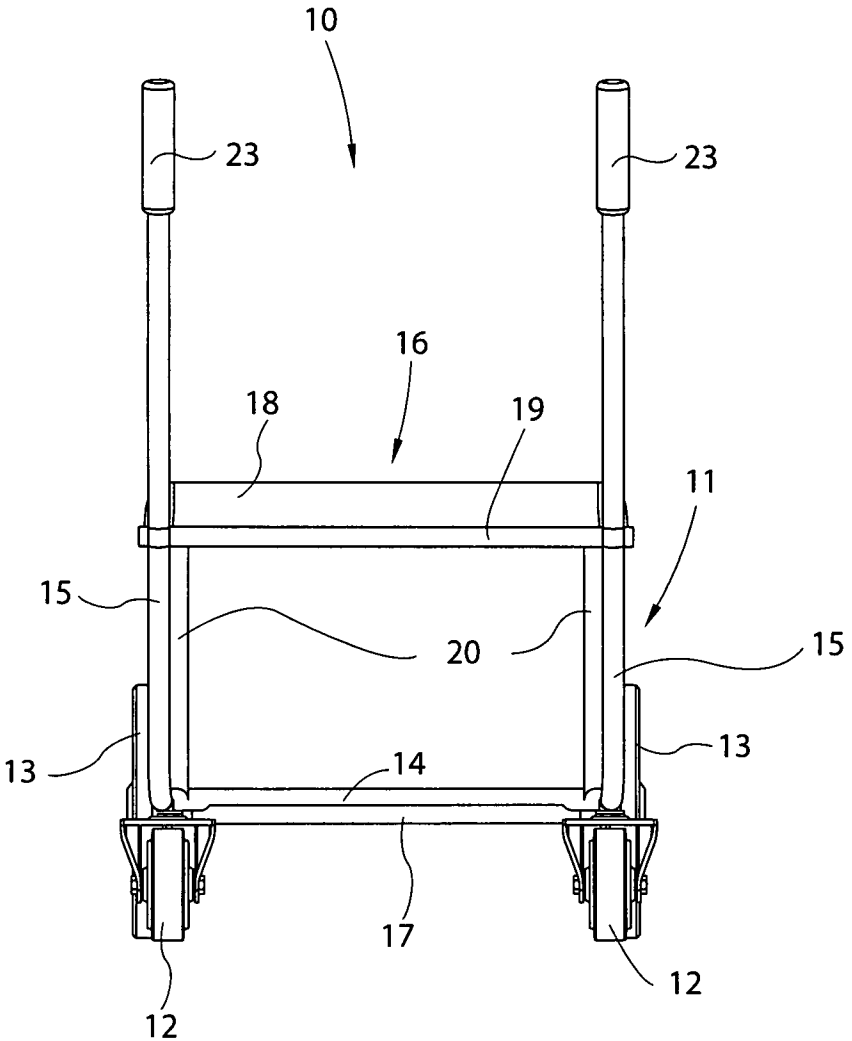
FIG. 4 is a front elevational view of the exercise apparatus shown in FIG. 1.

The apparatus 10 of this invention is referred to generally in FIGS. 1-4 and is intended to provide a compact rolling hamstring exercise apparatus 10 for increasing hamstring strength. It should be understood that the hamstring exercise apparatus 10 is intended to exercising the hamstring muscle group for various users such as athletes, patients and the like and should not be limited to being used by any particular user.

In a preferred embodiment, the hamstring exercise apparatus 10 preferably includes a portable frame 11 adapted to receive and support a user thereon. The frame 11 may be produced from heavy duty material, like aluminum, and measures 36" in length, and 19" in width and height. The frame 11 may further include a rear axle 17 extending transversely to a longitudinal length of the frame 11. The rear axle 17 has a planar top surface spanning along an entire width of the frame 11 for receiving and supporting the user feet thereon.

The present invention further includes a plurality of coextensively shaped handles bars 15 extend upwardly from the front end of the frame 11 and statically engage the seat section 16. Such handles bars 15 may be centrally positioned on the frame 11, and rise upward a comfortable 16 inches in height. Handle grips 23 may be positioned on each of the handles bars 15, and may be outward approximately 6 inches in length.

Advantageously, a seat section 16 is mounted at a front end of the frame 11 such that the frame 11 is provided with a first opening 24 intermediately disposed between the rear axle 17 and the seat section 16 for receiving user feet therethrough while the user is seated on the seat section 16 and facing the rear end of the frame 11. Such a frame 11 is further provided with a second opening 25 intermediately disposed between the handles bars 15. The second opening 25 receives the user feet therethrough while the user is seated on the seat section 16 and facing the front end of the frame 11. Such first 24 and second 25 openings advantageously provide room for feet or foot placement and leg movements as the hamstring exercise apparatus 10 is propelled forward during use.

Such a structural configuration solves the problem of unnecessarily tearing the hamstring muscle during training and rehabilitative procedures. Thus, the present invention provides the unexpected and unpredictable advantage of strengthening hamstring muscle groups without tearing muscle fibers while seated on a mobile exercise device. This advantageous result minimizes tears, strains, pulls, and other hamstring weaknesses. In this manner, the exercise apparatus 10 is not stationary, unlike conventional weight-lifting and nautilus machines. A user is able to determine his/her performance by measuring strength, endurance and speed gains by tracking his/her endurance and efficiency over time.

The present invention further includes a plurality of coextensively shaped front swivel wheels 12 coupled to the front end of the frame 11, and a plurality of coextensively shaped rear wheels 13 coupled to the rear axle 17. The front swivel wheels 12 may be freely rotated along a corresponding vertical axis 22 registered orthogonal to the bottom section 14. Such handles bars 15 are forwardly offset from the vertical axes 22 and thereby allow the user to lean forwardly and away from the seat section 16 during exercising procedures. The rear wheels 13 are fixedly aligned along a uniform direction and rotate about an x-axis 21 without swiveling away from the uniform direction as the front swivel wheels 12 rotate about the vertical axes 22 respectively. In this manner, the hamstring exercise apparatus 10 is easily maneuvered along tight corners and space-limited areas during exercising procedures.

The frame 11 further includes a U-shaped bottom section 14 having a rear end situated distally of the rear axle 17 for providing support to the user feet. Such a bottom section 14 extends along an entire longitudinal length of the frame 11 and is monolithically formed with the handles bars 15 at the front end of the frame 11. The bottom section 14 is oriented along a horizontal plane registered above the rear axle 17 and thereby supported by the rear axle 17, as perhaps best shown in FIGS. 1 and 3.

The seat section 16 may be centrally mounted above the front swivel wheels 12, which advantageously optimize movement while the hamstring training apparatus 10 is in use. Such a seat section 16 preferably includes first and second rectilinear legs 20 extending upwardly from the bottom section 14 of the frame 11. Such legs 20 are registered orthogonal to the bottom section 14 and located midway along the longitudinal length of the bottom section 14. A rectangular platform 19 is statically mated to top ends of the legs 20 and the handles bars 15 respectively wherein the platform 19 is centrally aligned along a width of the frame 11. A pad 18 is situated on the platform 19 for providing a cushioned surface on which the user sits during operating conditions. Such a pad 18 may be formed from a comfortable, cushiony foam or rubber upholstered in an attractive material.

The present invention further includes a method of utilizing a hamstring exercise apparatus 10 for strengthening hamstring muscles. Such a method preferably includes the chronological steps of: initially providing a portable frame 11 adapted to receive and support a user thereon. Such a frame 11 includes a rear axle 17 extending transversely to a longitudinal length of the frame 11, a seat section 16 mounted at a front end of the frame 11, and a plurality of coextensively shaped handles bars 15 extend upwardly from the front end of the frame 11 and statically engage the seat section 16. The frame 11 may be provided with a first opening 24 intermediately disposed between the rear axle 17 and the seat section 16. The frame 11 further may have a second opening 25 intermediately disposed between the handles bars 15.

The method further the chronological steps of: providing and coupling a plurality of coextensively shaped front swivel wheels 12 to the front end of the frame 11; providing and coupling a plurality of coextensively shaped rear wheels 13 to the rear axle 17; positioning user feet through the first opening 24 while the user is seated on the seat section 16 and facing the rear end of the frame 11; and positioning the user feet through the second opening 25 while the user is seated on the seat section 16 and facing the front end of the frame 11.

As an example, the user may sit on the seat section 16 and grip the handles bars 15. Then, the user can extend his/her legs as if he/she is walking or running forward, while remaining seated. Alternately, the user may place one or both feet flat on the ground and thereafter pull in a backward motion to propel himself/herself in a corresponding direction. In this manner, the method of exercising hamstring muscle groups allows the user to isolate and effectively concentrate on the hamstring muscle group without stressing or injuring other muscle groups. Of course, the user may exercise one leg at a time or both legs together. Also, the user may situate the apparatus 10 on a sloped surface for increasing/decreasing the force required to generate a momentum. As an option, the user may place his/her feet together on the ground surface and thrust backwards to propel the exercise apparatus 10 in a corresponding direction.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hamstring exercise apparatus for strengthening hamstring muscles, said hamstring exercise apparatus comprising:

a portable frame adapted to receive and support a user thereon, said frame including a rear axle extending transversely to a longitudinal length of said frame, a seat section mounted at a front end of said frame, and a plurality of handle bars extending upwardly from said front end of said frame and statically engaged to said seat section;

a plurality of front swivel wheels coupled to said front end of said frame; and a plurality of rear wheels coupled to said rear axle;

wherein said frame is provided with a first opening intermediately disposed between said rear axle and said seat section for receiving user feet therethrough while the user is seated on said seat section and facing said rear end of said frame;

wherein said frame is further provided with a second opening intermediately disposed between said handle bars, said second opening for receiving the user feet therethrough while the user is seated on said seat section and facing said front end of said frame;

wherein said frame comprises a U-shaped bottom section having a rear end situated distally of said rear axle for providing support to the user feet, said bottom section extending along an entire longitudinal length of said frame and being monolithically formed with said handle bars at said front end of said frame;

wherein said bottom section is oriented along a horizontal plane registered above said rear axle and thereby supported by said rear axle.

2. The hamstring exercise apparatus of claim 1, wherein said rear axle has a planar top surface spanning along an entire width of said frame, said top surface being adapted to receive and support the user feet thereon.

3. The hamstring exercise apparatus of claim 2, wherein said seat section comprises:

first and second rectilinear legs extending upwardly from said bottom section of said frame;

a rectangular platform statically mated to top ends of said legs and said handle bars respectively; and a pad situated on said platform for providing a cushioned surface on which the user sits during operating conditions;

wherein said legs are registered orthogonal to said bottom section and located midway along the longitudinal length of said bottom section.

4. The hamstring exercise apparatus of claim 3, wherein said platform is centrally aligned along a width of said frame.

5. The hamstring exercise apparatus of claim 4, wherein said front swivel wheels are freely rotated along a corresponding vertical axis registered orthogonal to said bottom section.

6. The hamstring exercise apparatus of claim 5, wherein said handle bars are forwardly offset from said vertical axes and thereby allow the user to lean forwardly and away from said seat section during exercising procedures.

7. The hamstring exercise apparatus of claim 6, wherein said rear wheels are fixedly aligned along a uniform direction and rotate about an x-axis without swiveling away from said uniform direction as said front swivel wheels rotate about said vertical axes respectively.

8. A hamstring exercise apparatus for strengthening hamstring muscles, said hamstring exercise apparatus comprising:

a portable frame adapted to receive and support a user thereon, said frame including a rear axle extending transversely to a longitudinal length of said frame, a seat section mounted at a front end of said frame, and a plurality of coextensively shaped handle bars extending upwardly from said front end of said frame and statically engaged to said seat section;

a plurality of coextensively shaped front swivel wheels coupled to said front end of said frame; and a plurality of coextensively shaped rear wheels coupled to said rear axle;

wherein said frame is provided with a first opening intermediately disposed between said rear axle and said seat section for receiving user feet therethrough while the user is seated on said seat section and facing said rear end of said frame;

wherein said frame is further provided with a second opening intermediately disposed between said handle bars, said second opening for receiving the user feet therethrough while the user is seated on said seat section and facing said front end of said frame;

wherein said frame comprises a U-shaped bottom section having a rear end situated distally of said rear axle for providing support to the user feet, said bottom section extending along an entire longitudinal length of said frame and being monolithically formed with said handle bars at said front end of said frame;

wherein said bottom section is oriented along a horizontal plane registered above said rear axle and thereby supported by said rear axle.

9. The hamstring exercise apparatus of claim 8, wherein said rear axle has a planar top surface spanning along an entire width of said frame, said top surface being adapted to receive and support the user feet thereon.

10. The hamstring exercise apparatus of claim 9, wherein said seat section comprises:

first and second rectilinear legs extending upwardly from said bottom section of said frame;

a rectangular platform statically mated to top ends of said legs and said handle bars respectively; and a pad situated on said platform for providing a cushioned surface on which the user sits during operating conditions;

wherein said legs are registered orthogonal to said bottom section and located midway along the longitudinal length of said bottom section.

11. The hamstring exercise apparatus of claim 10, wherein said platform is centrally aligned along a width of said frame.

12. The hamstring exercise apparatus of claim 11, wherein said front swivel wheels are freely rotated along a corresponding vertical axis registered orthogonal to said bottom section.

13. The hamstring exercise apparatus of claim 12, wherein said handle bars are forwardly offset from said vertical axes and thereby allow the user to lean forwardly and away from said seat section during exercising procedures.

14. The hamstring exercise apparatus of claim 13, wherein said rear wheels are fixedly aligned along a uniform direction and rotate about an x-axis without swiveling away from said uniform direction as said front swivel wheels rotate about said vertical axes respectively.

* * * * *